US008510976B2

(12) United States Patent
Kiser

(10) Patent No.: US 8,510,976 B2
(45) Date of Patent: Aug. 20, 2013

(54) PORTABLE LITERATURE DISPLAY

(76) Inventor: Thomas S. Kiser, Brooklyn, NY (US)

( * ) Notice: Subject to any disclaimer, the term of this patent is extended or adjusted under 35 U.S.C. 154(b) by 0 days.

(21) Appl. No.: 13/234,076

(22) Filed: Sep. 15, 2011

(65) Prior Publication Data

US 2012/0210929 A1 Aug. 23, 2012

Related U.S. Application Data

(60) Provisional application No. 61/382,986, filed on Sep. 15, 2010.

(51) Int. Cl.
*A47F 5/02* (2006.01)

(52) U.S. Cl.
USPC ..... 40/124; 40/124.2; 211/131.1; 211/163; 211/133.4

(58) Field of Classification Search
USPC ..... 40/124, 124.2, 124.4, 484, 493; 211/163, 211/133.4, 133.3, 129.1, 126.4, 78
See application file for complete search history.

(56) References Cited

U.S. PATENT DOCUMENTS

| | | | | | |
|---|---|---|---|---|---|
| 1,569,365 | A | * | 1/1926 | Goldberg | 211/163 |
| 3,051,319 | A | * | 8/1962 | Glaser | 211/133.4 |
| 3,844,230 | A | * | 10/1974 | Hudson et al. | 108/60 |
| 3,921,813 | A | * | 11/1975 | Cimino | 211/131.1 |
| 4,247,010 | A | * | 1/1981 | Eckert | 211/131.1 |
| 4,453,640 | A | * | 6/1984 | Cillario | 211/133.4 |
| D277,711 | S | * | 2/1985 | Cillario | D6/464 |
| 4,846,048 | A | * | 7/1989 | Hvilsted et al. | 92/5 R |

* cited by examiner

*Primary Examiner* — Casandra Davis
(74) *Attorney, Agent, or Firm* — Geoffrey E. Dobbin; Dobbin IP Law P.C.

(57) ABSTRACT

The present invention is a portable literature display. The preferred embodiment features a collapsible stand and sign, with a literature carousel that mounts upon the stand. The carousel is formed from a plurality of closable clamshell cases mounted upon a plurality of cross-beams and secured together in a ring. Leg flags are also provided to increase visibility.

5 Claims, 9 Drawing Sheets

PORTABLE LITERATURE DISPLAY

CROSS-REFERENCES TO RELATED APPLICATIONS

The present Application claims priority to prior file U.S. Provisional Application No. 61/382,986, filed Sep. 15, 2010 and incorporates the same by reference herein in its entirety.

FIELD OF THE INVENTION

The present invention relates to the field of commercial displays and more particularly relates to a portable display for literature.

BACKGROUND OF THE INVENTION

Information is valuable and the dissemination of information can prove critical. There are many situations where a person may wish to provide information to another. In some situations, it is desirable to locate the information in an area where people may gather. In these cases, people may have no idea where to go for information or may have no conscious need of desirable information, but may be latently curious. One such situation could be where a person is providing tourist information to visitors. Another situation could be where a person is engaging in proselytizing activities where information regarding a particular religion is provided to curious passers-by. Likewise, another situation could be to provide political campaign or petition literature to similar passers-by. Still another situation could be in-person sales. In each of these cases, and other conceivable ones, the desire is to go where people are gathered and provide a message to those who may become desirous of the information. The locations may be places where people temporarily gather, such as a sporting event, or may be a more regular location, such as a street corner or transit station.

Prior art literature displays tend to be foldable tables and stands. In most of these cases, a flat surface is used as a platform or table upon which literature is presented. As a plain table, literature is then generally exposed to the elements, including wind and precipitation which can either disperse or otherwise ruin the literature. The platform also tends to dictate the shape and size of the collapsed stand, which can be cumbersome. In one embodiment present invention provides a portable literature stand that may be easily assembled and disassembled for ready transportation. One embodiment also presents compartments for the storage of literature so as to protect literature from the elements and hold literature in the display. Signage may also be provided according to collapsible paradigm.

SUMMARY OF THE INVENTION

In view of the foregoing disadvantages inherent in the known types of literature displays, this invention provides a portable literature display that is easily transported from one location to another. As such, the preferred embodiment of the present invention's general purpose is to provide a new and improved literature display that is easily assembled and disassembled, will draw attention, and can provide protection to the literature.

To accomplish these objectives, the preferred embodiment of the portable literature display comprises a collapsible tripod stand with a central, extendable pole. A literature carousel is provided that slides onto the extendable pole and is held in place by a ledge or collar on the pole. Signage is also provided that mounts upon the top of the pole. The signage and carousel are also readily collapsible for easy stowage and transportation.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the literature display is herein described. It should be noted that the articles "a", "an", and "the", as used in this specification, include plural referents unless the content clearly dictates otherwise.

Figure 1:
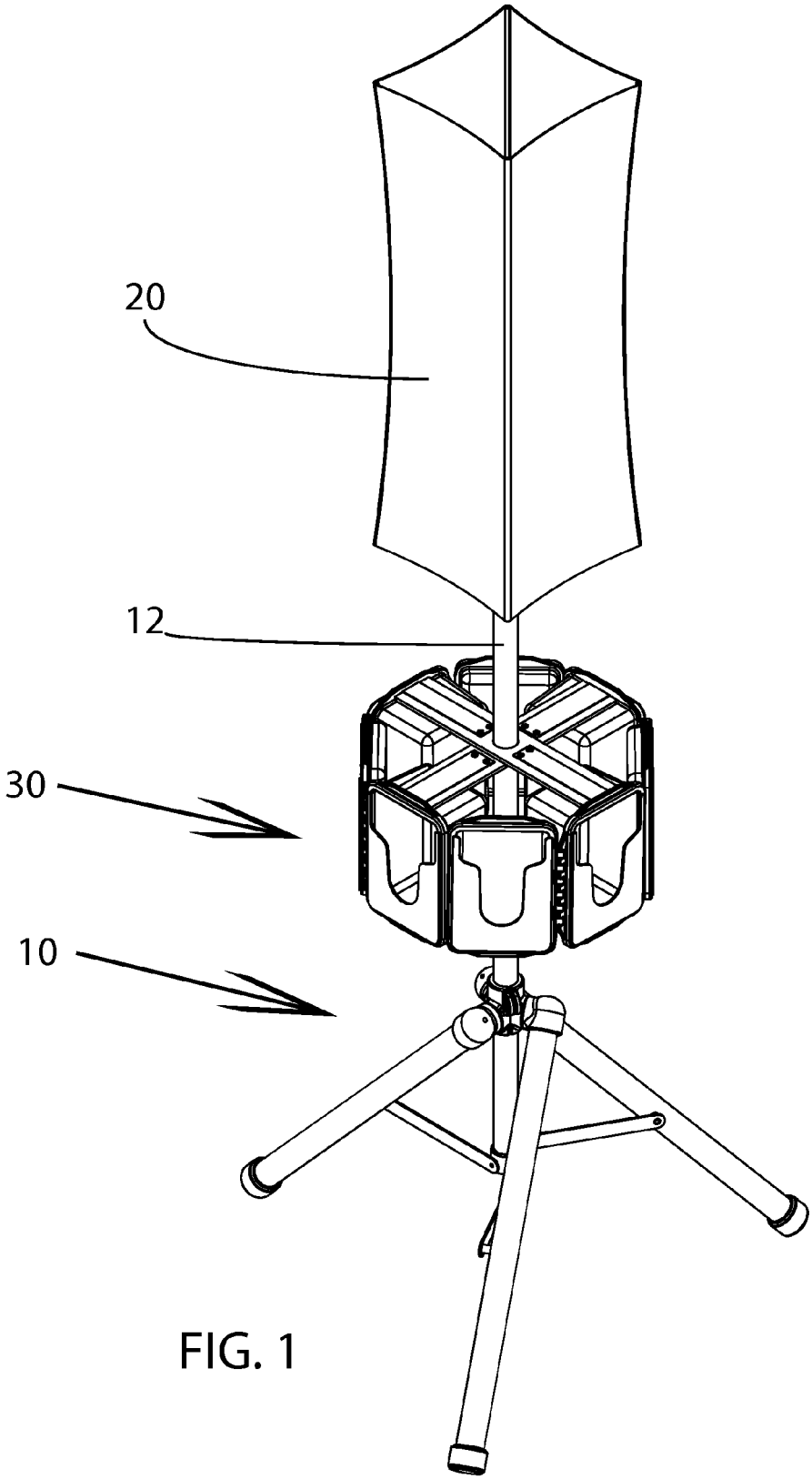
FIG. 1 is a front elevation of a preferred embodiment of the literature display.

With reference to FIG. 1, the preferred embodiment of the literature display has three main components, the stand 10, a sign 20 and the literature carousel 30. The stand is preferably a tripod stand with an extendable center pole 12. Other stand configurations are possible with the most important features being an extendable support of some form for the sign and a stable base that is easily collapsed.

Figure 2:
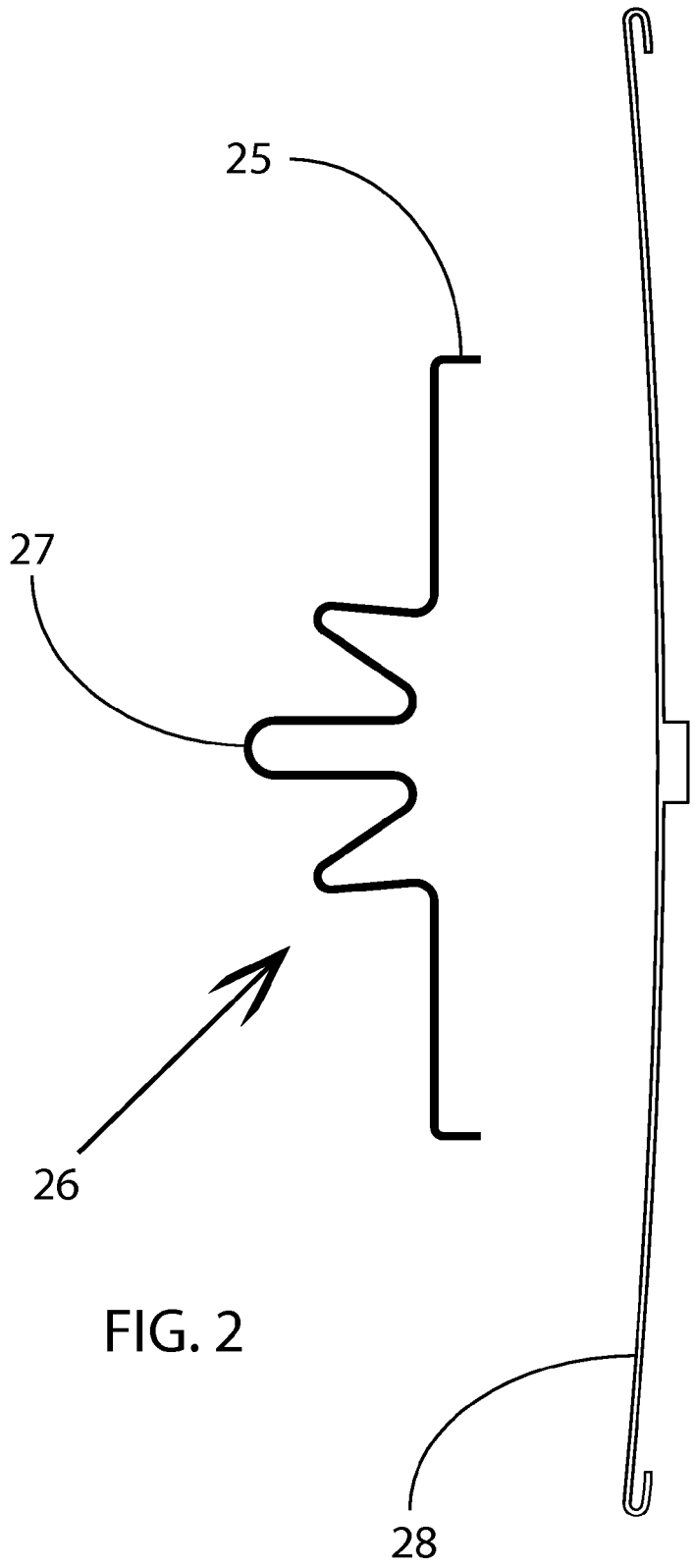
FIG. 2 is a plan view of the main components of a frame for a sign for use with the preferred embodiment of the literature display of FIG. 1.
Figure 3:
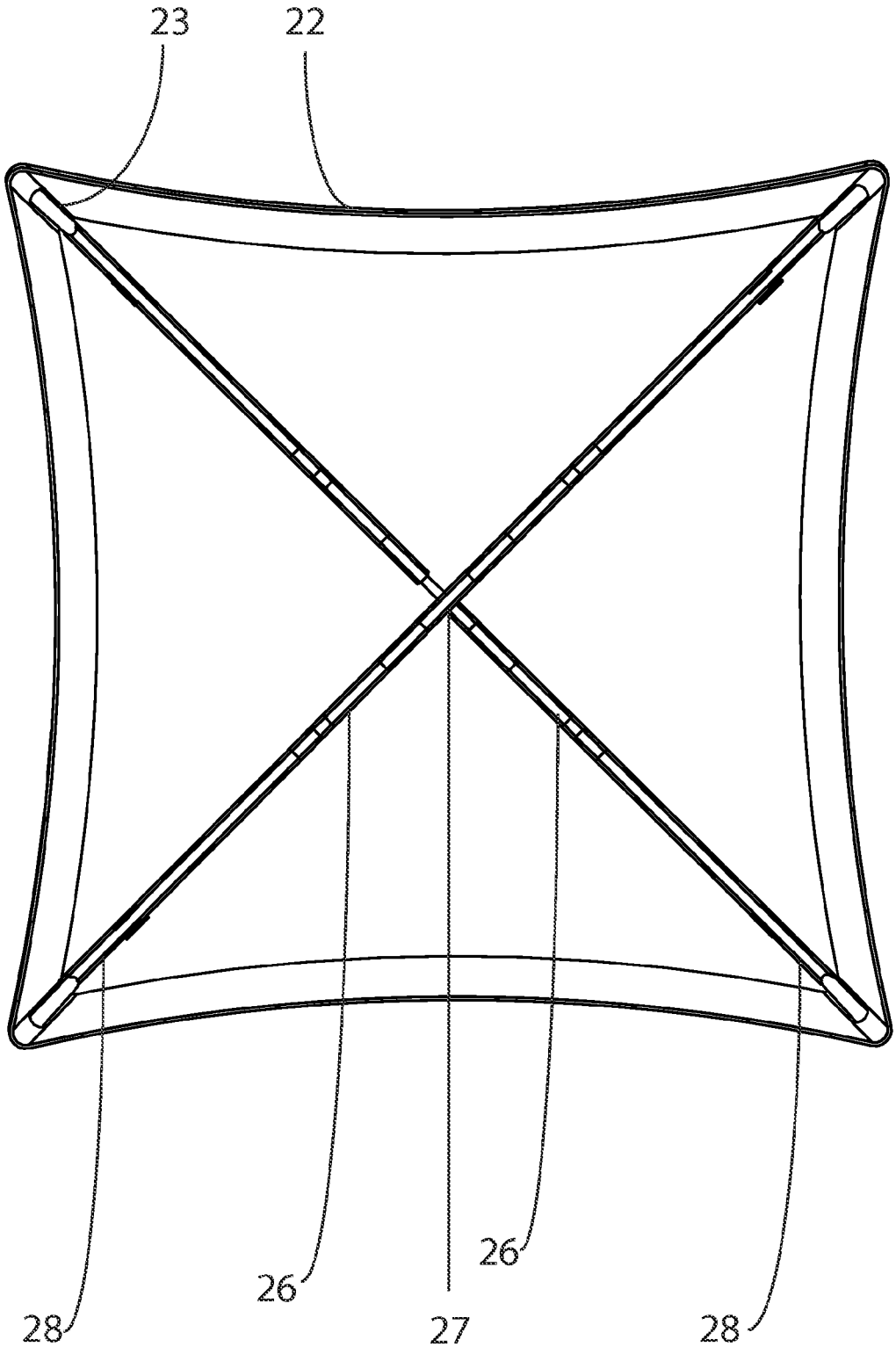
FIG. 3 is a plan view detailing final construction of the sign of FIG. 2
Figure 4:
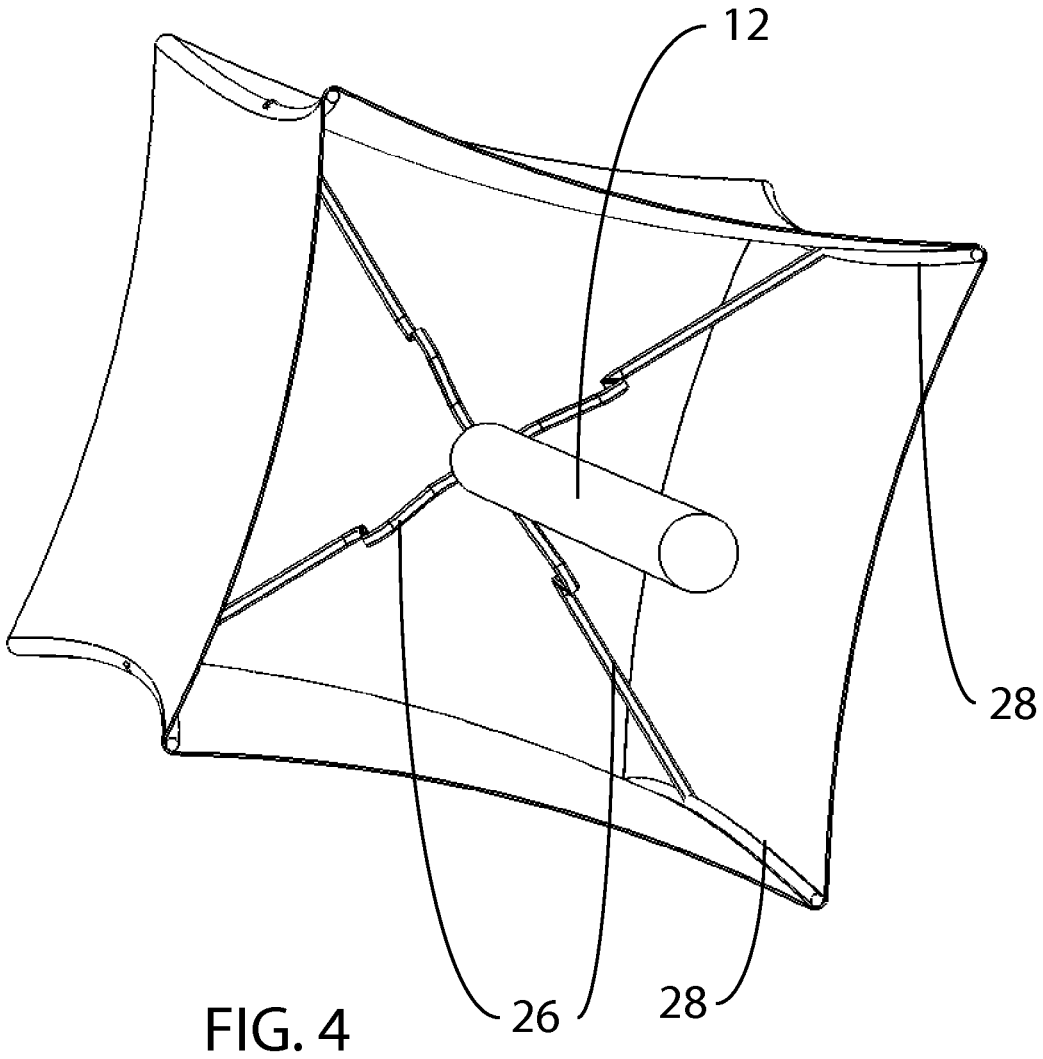
FIG. 4 is a perspective view showing the sign of FIG. 3 mounted on a pole used with the literature display of FIG. 1
Figure 5:
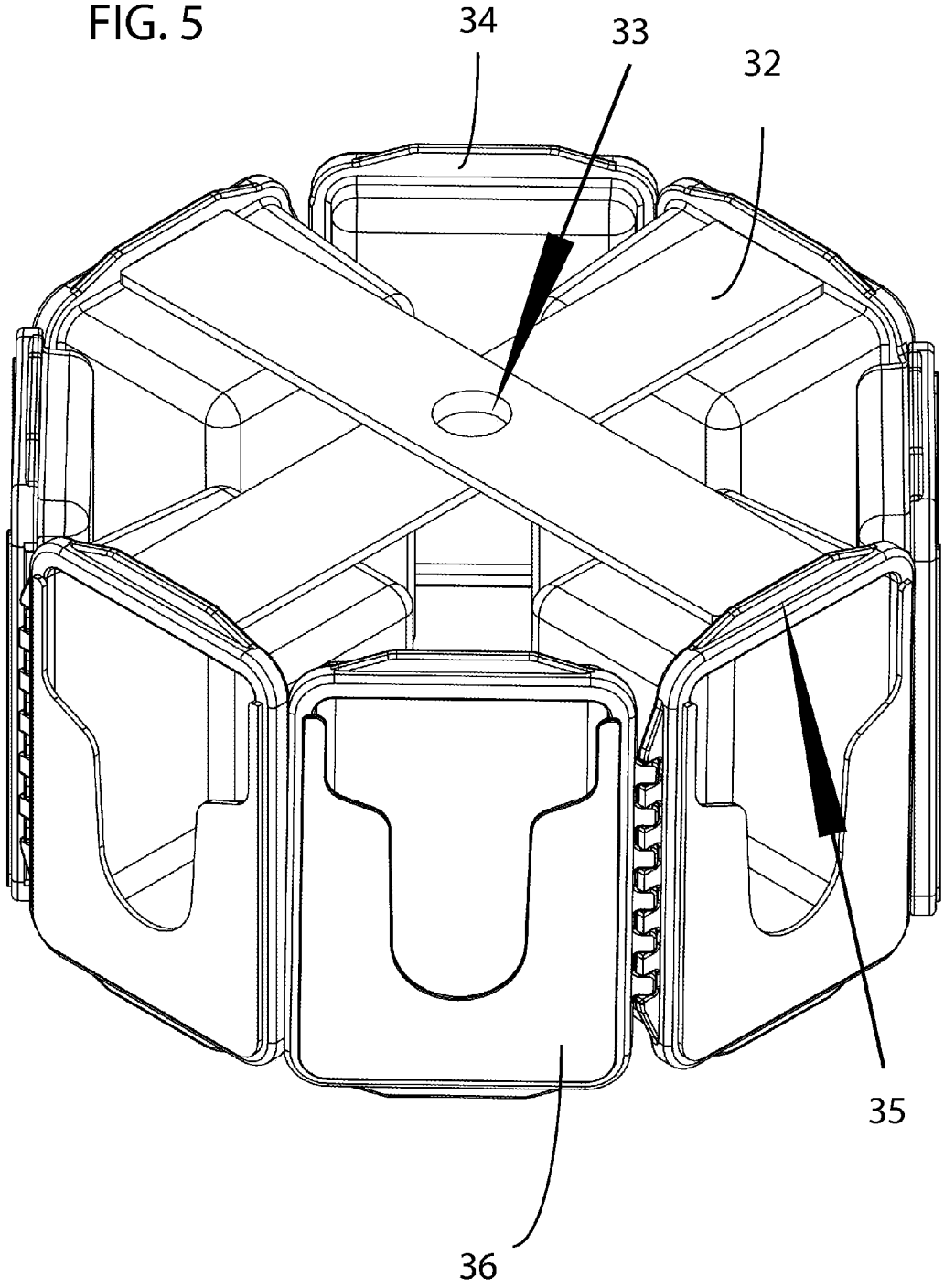
FIG. 5 is a perspective view of a literature carousel for use with the literature display of FIG. 1.

The sign 20 is mounted upon the center pole 12, as shown in FIG. 4, and has a collapsible frame 24 and a signage component 22. The frame, depicted in FIG. 2, is for a four-sided, three dimensional sign, though any sign configuration that is collapsible will be within the purview of the invention. The frame components for the depicted sign are two cross-beams 26 and four corner support members 28. The cross beams are bent in a manner to form a projection 27 that may be inserted into the pole 12 of the stand. They also have hooked ends 25 that interface with one of the corner support members. The support members define corners of a four-sided sign and have ends that fit into pockets 23 in the signage component. The combination of the frame and signage component provides mutual tension that keeps the sign deployed.

Figure 6:
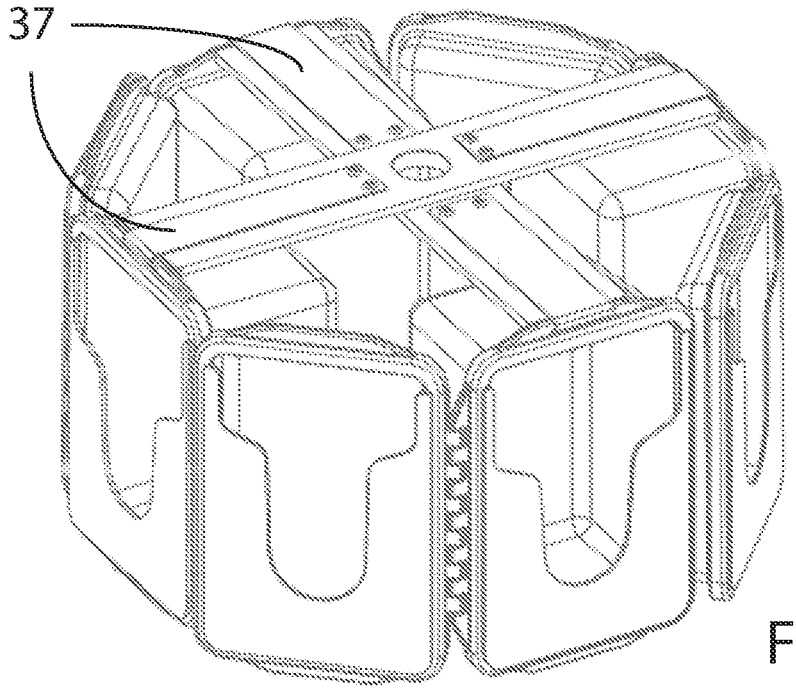
FIG. 6 is a perspective view of an alternate embodiment of a literature carousel for use with the literature display of FIG. 1.
Figure 7:
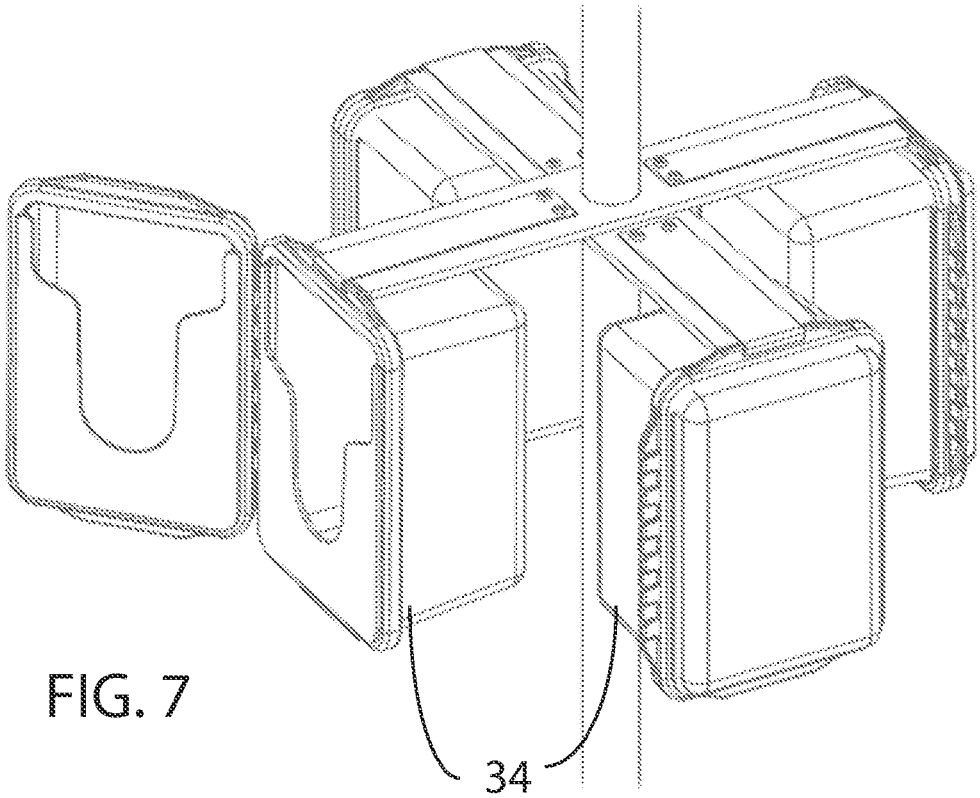
FIG. 7 is a perspective view of the literature carousel of FIG. 6, mounted upon the literature display.

The literature carousel 30 is mounted over the pole with two cross-beams 32, each with a central orifice 33. The carousel cross-beams 32 each have two ends that are mountable in slots 35 in four storage boxes 34, such as the type used by divers. These particular storage boxes open in a clam-shell configuration with two halves and each half may connect to another box, forming a ring of eight literature compartments. Each compartment protects literature from the elements and holds the literature in one location in a neat manner. This function is enhanced by the addition of a panel 36 which mostly covers the open face of the compartment. Literature need not even be taken out of the boxes when the display is stowed, allowing for easier initial set-up. The carousel 30 may rest on a ledge or collar 24 on the pole, possibly even the extension control of the pole. In another embodiment of the invention, the storage boxes 34 may be secured to the carousel cross-beams 32, such as with rivets and strap 37 as shown in FIGS. 6 and 7. The addition of this securing means holds the storage boxes on the carousel in the event of inclement weather and wind and also in case of jostling by a crowd. The use of the strap also helps lessen the possibility of breakage of the boxes in case the sign falls. This is because the flexible strap gives against the slots, whereas in the first embodiment, the slots tend to give against the cross-beams.

Figure 8:
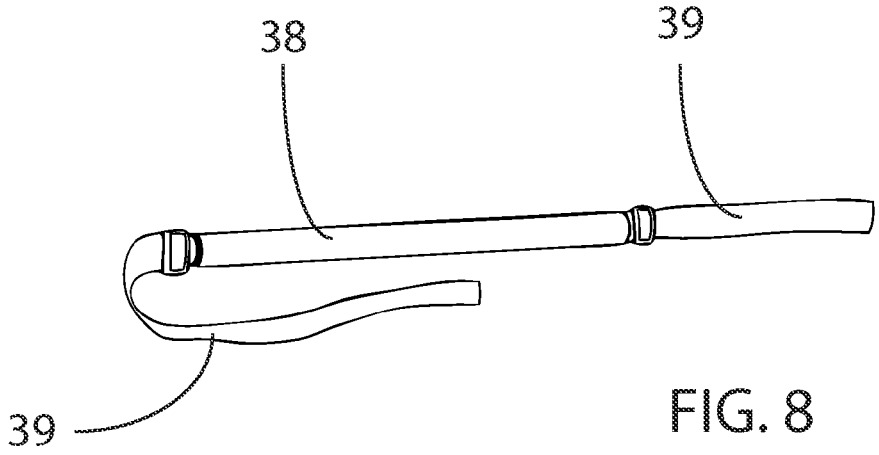
FIG. 8 is a top plan view of a tether for use with the literature display.
Figure 9:
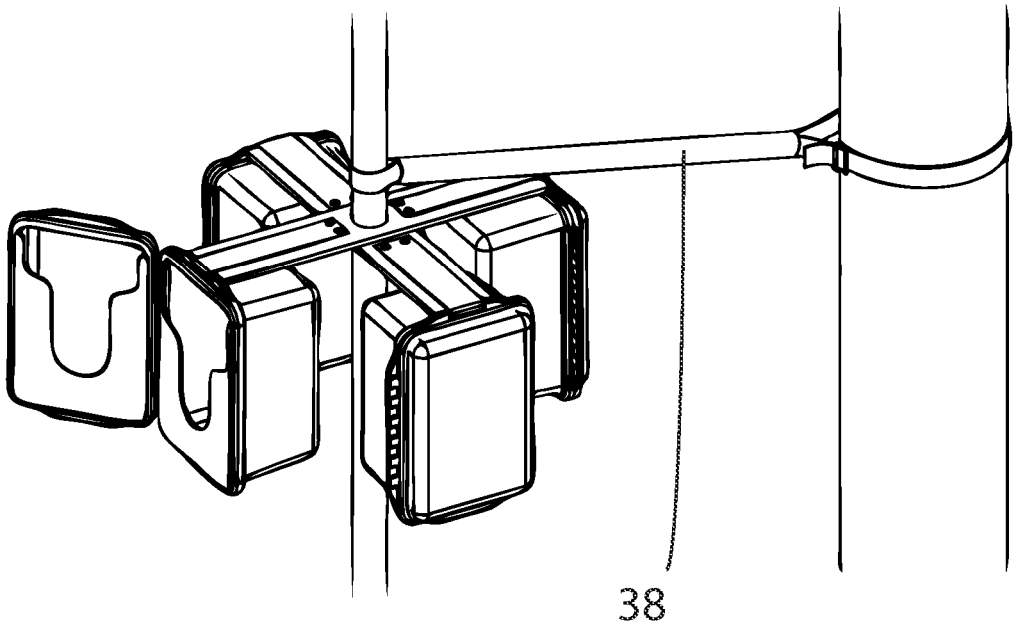
FIG. 9 is a side elevation depicting use of the tether of FIG. 8.
Figure 10:
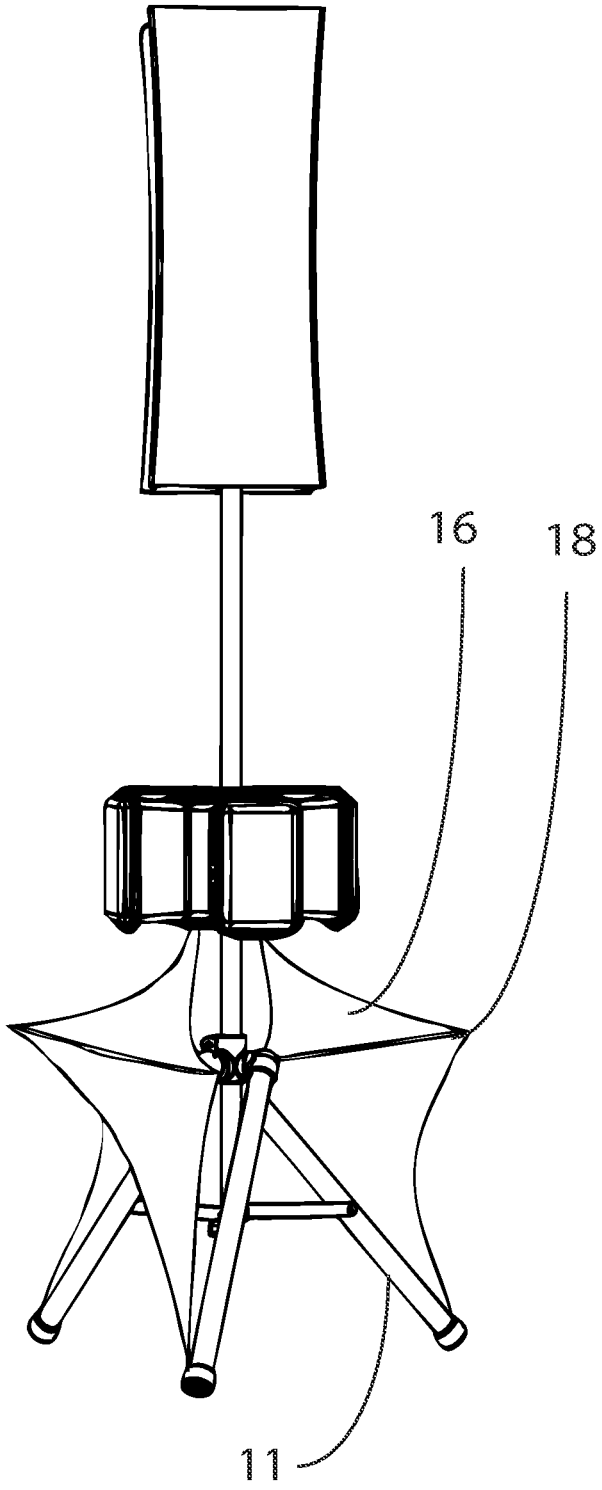
FIG. 10 is a plan view of a second embodiment of the literature display.
Figure 11:
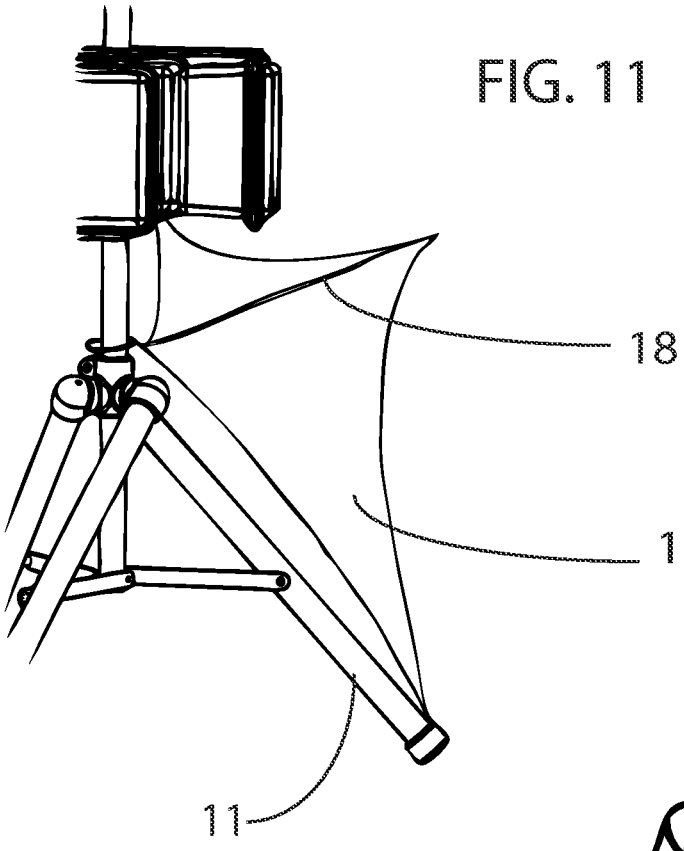
FIG. 11 is a perspective view of the leg flags used in the embodiment depicted in FIG. 10.
Figure 12:
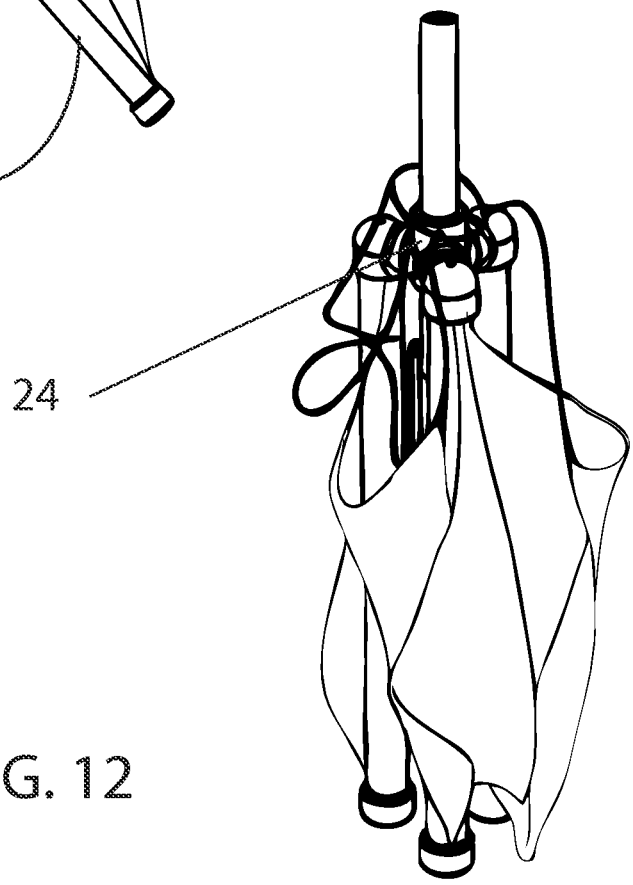
FIG. 12 is a perspective view of the literature display of FIG. 10 in partial disassembly.

Additions may be made to the display. One addition is the use of a tether 38, seen in FIGS. 8 & 9. The depicted tether is a rigid bar with two straps 39 protruding from either end, though any suitable construction may be utilized. As seen in FIG. 7, the tether is strapped to the display post and also to a rigid support, such as a tree or lamp stand, to secure the display in windy conditions. Another additional feature are a number of leg flags 16, FIGS. 10 and 11, that may be positioned on the legs 11 of the display so as to alert passersby as to the presence of the legs and give the impression of a more solid object that passersby will instinctively avoid in their steps. The leg flags are secured in three corners to a leg, the post and a juncture corner of the leg and post. A flexible support rod 18 extends diagonally from the juncture corner to the corner opposite. Thus, when the stand's legs are extended, the flag 16 is tightened at the three corners and the rod 18 projects outward, tightening the flag at the fourth, unsecured corner.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A portable literature display comprising:

a. A collapsible stand with a central post and a plurality of stowable legs;

b. A plurality of cross-beams, each with a central hole, such that the cross-beams may slide over the central post;

c. A display sign mountable upon the central post; and d. A plurality of literature cases, twice as many as a number of cross-beams; each literature case comprising:

i. Two case halves, hinged together into a clamshell configuration;

ii. Structure by which the halves may be mutually secured in a closed configuration, said structure also capable of joining with corresponding structure on another literature case's case half when in an open configuration;

wherein the literature cases are mounted upon the cross-beams, two to a cross beam, and secured together in a ring about the cross-beams, thereby forming a carousel.

2. The portable literature display of claim 1 further comprising a collar, slidable over the central post and securable in a given position upon the central post such that the cross-beams may rest thereupon.

3. The potable literature display of claim 2, the central post being extensible and the collar being a control to a length of extension of the central post.

4. The portable literature display of claim 1, further comprising a plurality of straps, secured to the cross-beams which also then secure the literature cases thereon.

5. The portable literature display of claim 1, further comprising collapsible flags secured to the legs, which deploy upon deployment of the legs.

* * * * *